United States Patent [19]

Simpson

[11] 3,945,158

[45] Mar. 23, 1976

[54] METHOD AND CLIP FOR INSTALLATION OF INSULATION

[76] Inventor: Ronnie C. Simpson, P.O. Box 444, Carl Junction, Mo. 64834

[22] Filed: Feb. 10, 1975

[21] Appl. No.: 548,403

Related U.S. Application Data

[63] Continuation-in-part of Ser. No. 499,445, Aug. 22, 1974.

[52] U.S. Cl. ..... 52/22; 52/502

[51] Int. Cl.[2] ..... E04B 7/00

[58] Field of Search ..... 52/22, 60, 94, 404, 502, 52/627, 628; 24/73 B, 73 BC; 160/394, 397

[56] References Cited

UNITED STATES PATENTS

| | | | |
|---|---|---|---|
| 1,053,199 | 2/1913 | Moore | 160/394 |
| 1,171,952 | 2/1916 | Higgin | 160/394 X |
| 3,336,704 | 8/1967 | Clay | 52/22 X |
| 3,766,700 | 10/1973 | Nuss | 52/502 X |

*Primary Examiner*—J. Karl Bell

*Attorney, Agent, or Firm*—Head, Johnson & Chafin

[57] ABSTRACT

An eave strut clamp assembly for installation of roof insulation material in metal building structures to prevent leaking of moisture from the eave strut back along the insulation. The assembly comprises an elongated bar for fastening the insulation material to the inside surface of an eave strut having a cross-sectional C-shape and a plurality of elongated flexible clip members for holding the elongated bar in place. The edge of the insulation is pulled into the open space of the eave strut, the bar is placed against the insulation and the clip is bent to conform to the inside surface of the eave strut, the upper edge of the clip being in contact with the elongated bar for holding the bar in place, which in turn secures the edge of the insulation to the inside surface of the eave strut.

4 Claims, 5 Drawing Figures

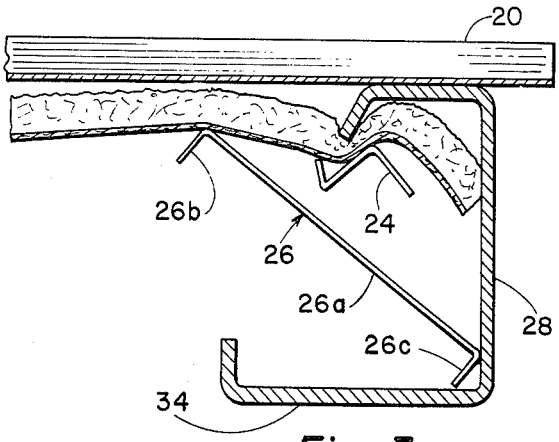
Fig. 3
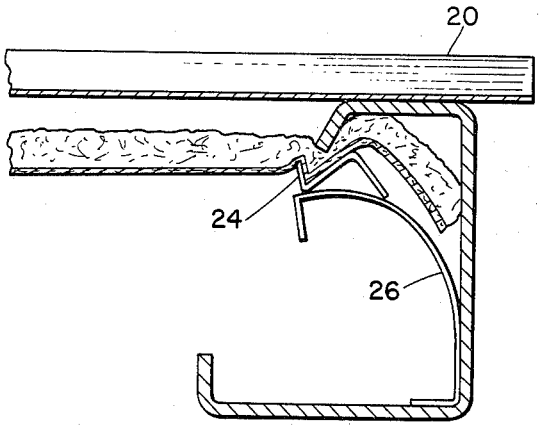
Fig. 4
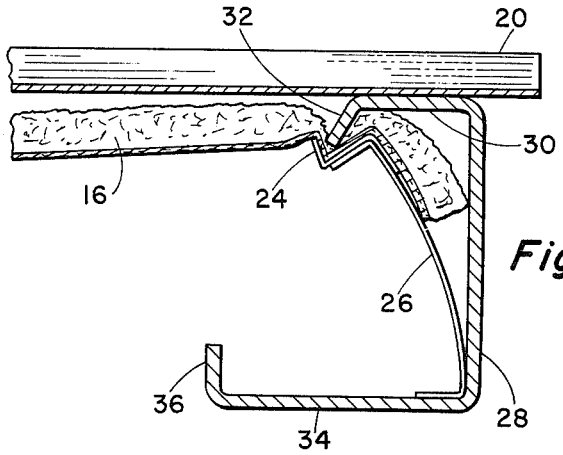
Fig. 5
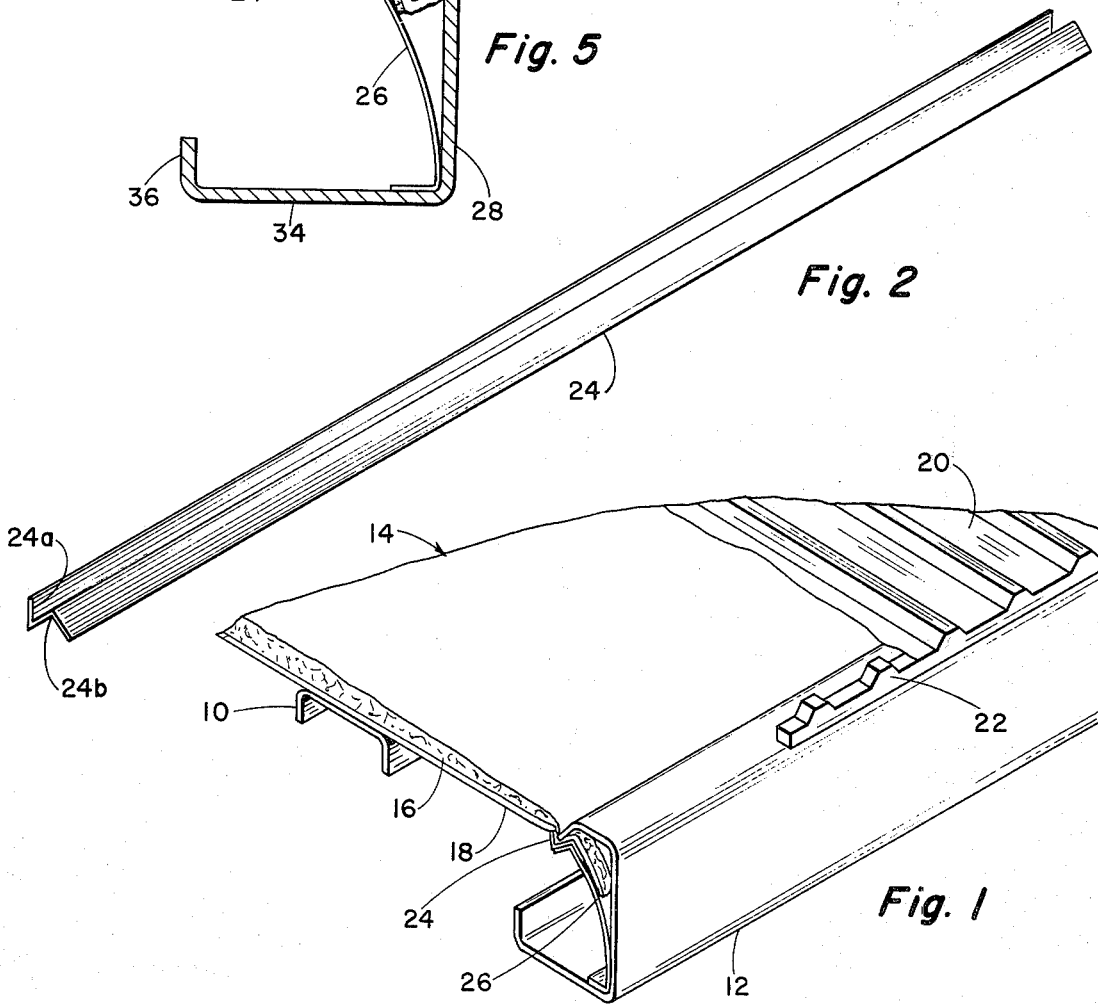
Fig. 2
Fig. 1

METHOD AND CLIP FOR INSTALLATION OF INSULATION

CROSS REFERENCE

This application is a continuation-in-part of applicant's copending application, Ser. No. 499,445 filed Aug. 22, 1974, and entitled METHOD AND CLIP FOR INSTALLATION OF INSULATION.

BACKGROUND OF THE INVENTION

1. Field of the Invention.

The present invention relates to installation of building insulation material and more particularly but not by way of limitation to a method and means for clamping the edge of roof insulation material in metal buildings to the eave strut in a way to prevent exposure thereof to rain and moisture.

2. Description of the Prior Art.

In the construction of metal buildings, strip insulation is normally provided between the purlins and the roof sheet, the outer ends or edges of said insulation being attached to the top of the eave strut.

The insulation is normally of a type having spun fiberglass material in a sheet which is faced on one side with a vinyl foil material glued thereto for purposes of providing a vapor barrier.

Upon construction of metal buildings the insulation is pulled over the purlins with the vapor barrier down or facing the interior of the building. The ends or edge of the insulation is then attached to the top surface of an eave strut. The recommended correct way to attach to the eave strut is to fold back the edge of the insulation with vapor barrier outside and then using rivets, screws or the like, to attach the folded edge to the top of the eave strut. This prevents the fiber portion of the insulation from being exposed to the weather between the eave strut and the roof sheet.

However, in practice, it has been found that due to constant time pressure for completion of said buildings and the low degree of skilled labor used, the edge of the insulation is usually left unfolded and exposed to the weather between the eave strut and the roof sheet. During rain, snow or wet weather, water or moisture is wicked back along the insulation fiber and there accumulates until the insulation starts sagging.

At this point the user of the building does not know whether there is a leak in the roof or wicking has occurred. Often much time and labor is expended fruitlessly searching for a roof leak that doesn't exist.

The present invention is particularly designed and constructed to overcome the above disadvantages and prevent moisture accumulation due to wicking as hereinbefore described. Since the eave struts in most metal buildings have a cross-sectional C-shape with the open face thereof directed inwardly, applicant has found that the insulation edge may be inserted into this open face of the eave strut below the top surface thereof, instead of on the top of the eave strut as hereinbefore set forth.

In applicant's copending application Ser. No. 499,445, filed Aug. 22, 1974, a substantially U-shaped insulation clip comprising an elongated flexible metal strip bent at each end was used to clamp the insulation in place inside the C-shaped eave strut. The insulation clip was bent into a substantially C-shaped configuration and inserted into the eave strut below the insulation edge. Upon releasing the clip it would tend to spring open thereby firmly clamping the edge of the insulation between the upper end of the clip and the inside surface of the eave strut. The roof sheet was then installed on top of the eave strut and sealed to prevent moisture from entering through the area between the roof sheet and the eave strut.

This installation served not only to prevent moisture accumulation but represented a significant savings in labor due to the ease of installation as opposed to installation by the fold back and rivet method hereinbefore described.

Although the clip member method worked satisfactorily, there tended to be sags in the insulation between clips which detracted from the overall appearance of the job.

The present invention, however, overcomes this difficulty by providing an elongated bar having a cross-sectional Z-shape whereby one side of the bar conforms to the shape of the upper lip of the eave strut and where the insulation edge may be gripped between the elongated bar and the inside surface of the eave strut. The opposite side of the bar is shaped to conform to the one end of the insulation clips so that the insulation clips may be inserted within the inside surface of the eave strut, thereby pressing against the Z-shaped bar for holding the Z-shaped bar in place. The bar in turn holds the edge of the insulation firmly against the inside surface of the eave strut. This provides uniform support for the insulation edge, prevents leaking and is less likely to cause damage to the insulation material than the use of clips alone since the clip does not come into pressing contact with the insulation material.

DESCRIPTION OF THE DRAWINGS

Other and further advantageous features of the present invention will hereinafter more fully appear in connection with a detailed description of the drawings, in which:

FIG. 1 is a prospective view of a roof eave having insulation installed by use of elongated bars and clips embodying the present invention.

FIG. 2 is a detailed prospective view of the elongated bar of FIG. 1.

FIGS. 3, 4 and 5 are elevational cross-sectional views depicting the steps of installing insulation using the elongated bar and associated clips.

DESCRIPTION OF THE PREFERRED EMBODIMENT

Referring to the drawings in detail, reference character 1 depicts a typical metal building roof eave structure. The structure generally comprises a plurality of spaced elongated parallel roof purlins, one of which is shown and indicated by reference character 10. These roof purlins make up the framework for the roof and terminate at the edge with an eave strut 12, having a cross-sectional C-shape with the open face thereof facing inwardly toward the inside of the building. The eave struts are supported by vertically disposed frame members (not shown).

A plurality of insulation strips or blankets, generally indicated by reference character 14, are pulled tightly over these purlins. The insulation blankets 14 generally comprise a blanket 16 of spun fiberglass which ranges from 1 to 2 inches thick and which is very compressible. The lower surface of the fiberglass blanket 16 is provided with a vapor barrier 18 which is normally of a vinyl or foil material and is glued to the fiberglass 16 by a suitable adhesive.

A roof sheet 20 which is normally constructed of corrugated metal material is then laid over the fiberglass blanket and attached to the purlins 10 by means of screws or rivets (not shown). The outer edges of the corrugated sheets 20 are secured to the top surface of the eave strut 12. Normally, to close the space between the edge of the roof sheet 20 and the upper surface of the eave strut 12, a rubber or plastic molding 22 is placed between the said eave strut 12 and the roof sheet 20, the said molding 22 having an upper surface which conforms to the shape of the corrugation of the roof sheet 20.

As hereinbefore set forth, the prior art method of securing the edge of the insulation 14 at the eave strut 12 is to fold back the edge of the insulation 14 with the vapor barrier 18 on the outside of the fold and rivet same to the top of the eave strut.

However, as hereinbefore set forth, it has been found to be common practice due to the constant pressure of time to complete the structure and the use of relatively unskilled labor in assembling these metal buildings, that the edge of the insulation is often pulled tightly against the upper surface of the eave strut and left unfolded. The roof sheet 20 and associated rubber molding 22 is then installed with the outer edge of the insulation or fiberglass material 16 being exposed to the outer surface of the building. This improper insulation is often missed during inspection of the building due to guttering (not shown) which is usually added along the eave strut of the building after completion of the roof insulation.

Often after this improper installation and many times after the building has been occupied and is in use, the edge of the building is subject to prolonged exposure to moisture during the rainy seasons or due to snow and ice melting on top of the building thereby causing wicking of this moisture back along the fiberglass material. This in turn causes a great amount of moisture accumulation in the fiberglass material 16 itself. This accumulation of moisture is prevented from drying inside the building due to the vapor barrier 18 on the inside surface thereof. Therefore, the moisture has no place to go and continues to accumulate. After much accumulation the insulation starts to sag, thereby indicating to the user of the building that there is a roof leak. It is often the case that many labor man hours are used in searching for a roof leak that doesn't exist before it is discovered that wicking action has taken place due to improper installation of the insulation material.

The present invention as shown in FIGS. 1 through 5 depicts a method and means for pulling the edge of the insulation over the top surfaces of the purlins and into and through the open face of the eave strut 12. The insulation is then clipped to the upper lip and inside surface of the eave strut 12 by means of a plurality of elongated bars having cross-sectional Z-shapes, one of which is shown at FIG. 2 and indicated by reference character 24. The Z-bars 24 are held in place by a plurality of clip members indicated by reference character 26. Referring now to FIGS. 3, 4 and 5, the C-shaped eave strut member generally indicated by reference character 12 normally has a vertical panel 28, a top panel 30, secured along the upper edge of the panel 28 and extending inwardly terminating in a downwardly extending lip member 32. The bottom edge of the vertical panel 28 is provided with an inwardly extending bottom panel 34 secured thereto and terminating in an upwardly extending lip member 36 thereby forming a substantially cross-section C-shape with the open face thereof directed inwardly toward the interior of the building.

The Z-bar 24 comprises three panels arranged in a cross-sectional Z-shape which provides a groove on one side which will be designated by reference character 24A for receiving the upper lip 32 of the eave strut 28 therein and which is capable of sandwiching the edge of the insulation material 14 between the bar 24 and the inside surface of the eave strut. The panels of the Z-bar 24 also provide a groove in the opposite side designated by reference character 24B for receiving the upper end of the clip 26 therein as will be hereinafter set forth.

The clip member 26 generally comprises an elongated flexible metal strip 26A having end pieces 26B and 26C which form a substantially U-shaped member as shown in FIG. 3. Normally the strips are 1 to 2 inches wide by 10 to 12 inches long according to the cross-sectional size of the eave strut. The clip member 26 may be constructed of any suitable flexible metal such as steel or aluminum or could conceivably be constructed of a plastic composition so long as the clip member may be deformed and after having been deformed will tend to spring back to its original shape.

Installation of the insulation material 14 is accomplished by stretching said insulation material over the purlin 10 as shown in FIG. 1 with the outer edge of the insulation material being pulled tightly into the open face of the eave strut 12. The Z-bar member 24 is then positioned under the lip 32 of the eave strut and forced upwardly as shown in FIG. 3, thereby sandwiching the insulation material 14 between the eave strut lip 32 and Z-bar groove 24A. The Z-bar 24 is then clipped into place by a plurality of clip members 26. Each clip member 26 is installed by placing the end portion 26C against the juncture between the panels 28 and 34 of the eave strut 12 as shown in FIG. 3.

Pressure is then applied to the center portion 26A of the clip thereby forcing said clip back into the inside surface of the eave strut as shown in FIG. 4. This is accomplished by deforming or bending the clip member 26 in order for the upper end 26B to pass under the lip 32 of the eave strut 12. It is apparent that the end member 26C will be brought to rest against the bottom member 34 of the eave strut while the lower portion of the strip member 26A will rest directly against the inside surface of the vertical member 28 of the eave strut 12.

After the upper end of the clip member 26 is forced past the lip member 32 of the eave strut, it will tend to straighten out against the groove 24B of the Z-bar. Thus the upper end of the clip member is forced against the Z-bar 24 thereby firmly clamping the edge portion of the insulation between the Z-bar 24 and the inside surface of the eave strut 12.

It is readily apparent that the clip member 26 should be of sufficient length to lock the Z-bar in place as shown in FIG. 5. A plurality of clip members 26 are then spaced along the eave strut thereby holding the Z-bar segments in place against the edge of the insulation material.

The roof sheet 20 and associated molding 22 may be then installed in a normal manner which will tend to prevent moisture or rain from blowing back between the roof sheet 20 and the eave strut 12 into the area of insulation 14.

From the foregoing it is apparent that the present invention provides a novel method and means for securing the edges of insulation material building construction to prevent exposure of the edge thereof to the weather and hence prevent wicking of moisture back through the insulation material.

Whereas, the present invention has been described in particular relation to the drawings attached hereto, it is obvious that other and further modifications, apart from those shown or suggested herein, may be made within the spirit and scope of this invention. For example, the drawings depicted herein indicate a flat roof structure whereas this installation technique and means may be used with sloping roof structure or with eave struts having modified cross-sectional configurations.

What is claimed:

1. In combination with a metal structure roof having an eave strut along the edge thereof, said eave strut having a substantially cross-sectional C-shape, the open face thereof directed inwardly, and having insulation on the inside surface of the roof, the edge of the insulation terminating at the eave strut; an elongated bar disposed against the edge of the insulation for securing the insulation to the inside surface of the eave strut, and a deformable clamp means disposed against the inside surface of the eave strut in contact with the elongated bar for securing the elongated bar in place.

2. A device as set forth in claim 1 wherein the deformable clamp means comprises an elongated strip of flexible material which is capable of being deformed to conform to the inside surface of the eave strut, with said material having a tendency to return to its original shape after deformation thereof, one end of each elongated strip being disposed against the elongated bar.

3. A device as set forth in claim 2 wherein the elongated strip is provided with flange members at each end thereof to form a substantially cross-sectional U-shape, the clamp means being capable of being deformed into a substantially C-shape to conform to the inside surface of the eave strut and wherein the elongated bar has a substantially cross-sectional Z-shape thereby providing a first groove for receiving the upper edge of the C-shaped eave strut therein and an oppositely disposed second groove for receiving one end of the clamp means therein.

4. A method of installing insulation on the inside surface of a metal roof structure having an eave strut along the edge thereof and a roof sheet covering the structure, said eave strut having a substantially cross-sectional C-shape, the open face thereof directed inwardly, said roof sheet having the edge thereof attached to the top of the eave strut, comprising the steps of:

a. attaching insulation material to the inside surface of the roof sheet;

b. pulling the edge of the insulation into the open face of the eave strut;

c. holding the edge of the insulation against the inside surface of the eave strut by means of an elongated bar; and d. clamping the bar into place thereby sandwiching the edge of the insulation material between the bar and the inside surface of the eave strut.

* * * * *